US008136456B2

(12) United States Patent
Sammartino

(10) Patent No.: US 8,136,456 B2
(45) Date of Patent: Mar. 20, 2012

(54) FRICTION WEDGE FOR RAILROAD CAR TRUCK

(75) Inventor: Giuseppe Sammartino, Mount Prospect, IL (US)

(73) Assignee: Wabtec Corporation, Wilmerding, PA (US)

( * ) Notice: Subject to any disclaimer, the term of this patent is extended or adjusted under 35 U.S.C. 154(b) by 135 days.

(21) Appl. No.: 12/540,442

(22) Filed: Aug. 13, 2009

(65) Prior Publication Data

US 2011/0036264 A1 Feb. 17, 2011

(51) Int. Cl.
*B61F 5/04* (2006.01)

(52) U.S. Cl. ..... 105/198.2; 105/198.4

(58) Field of Classification Search ..... 105/198.2, 105/198.4, 223
See application file for complete search history.

(56) References Cited

U.S. PATENT DOCUMENTS

| | | | | |
|---|---|---|---|---|
| 2,169,715 | A | 8/1939 | Webb | |
| 3,714,905 | A | 2/1973 | Barber | |
| 3,977,332 | A | 8/1976 | Bullock | |
| 4,109,585 | A | 8/1978 | Brose | |
| 4,244,298 | A | 1/1981 | Hawthorne et al. | |
| 4,295,429 | A | 10/1981 | Wiebe | |
| 4,825,776 | A | 5/1989 | Spencer | |
| 4,915,031 | A | 4/1990 | Wiebe | |
| 4,974,521 | A * | 12/1990 | Eungard | 105/198.4 |
| 5,511,489 | A | 4/1996 | Bullock | |
| 5,555,818 | A | 9/1996 | Bullock | |
| 5,850,795 | A | 12/1998 | Taillon | |
| 5,943,961 | A * | 8/1999 | Rudibaugh et al. | 105/198.2 |
| 6,269,752 | B1 | 8/2001 | Taillon | |
| 6,659,016 | B2 | 12/2003 | Forbes | |
| 6,688,236 | B2 | 2/2004 | Taillon | |
| 6,874,426 | B2 | 4/2005 | Forbes | |
| 6,895,866 | B2 | 5/2005 | Forbes | |
| 6,920,828 | B2 | 7/2005 | Forbes | |
| 7,004,079 | B2 | 2/2006 | Forbes | |
| 7,255,048 | B2 | 8/2007 | Forbes | |

(Continued)

FOREIGN PATENT DOCUMENTS

WO WO 2005/005219 A2 1/2005

OTHER PUBLICATIONS

PCT Notification of Transmittal of the International Search Report and the Written Opinion of the International Searching Authority, or the Declaration dated Apr. 26, 2011 for PCT/US2010/044541.

*Primary Examiner* — S. Joseph Morano
*Assistant Examiner* — Zachary Kuhfuss
(74) *Attorney, Agent, or Firm* — Cook Alex Ltd.

(57) ABSTRACT

A single-piece friction wedge for use in damping relative movement between a bolster and a side frame of a railroad car truck includes a generally horizontal bottom surface, a generally vertical front surface, and a back surface oriented at an acute primary angle with respect to the front surface. The back surface has first and second sloped surfaces which are angled toward each other. A damping system employing such a friction wedge includes a bolster pocket insert. The bolster pocket insert is configured to be at least partially received within a pocket of the bolster and has an inner face configured to engage the pocket of the bolster and an outer face configured to engage at least one of the first and second sloped surfaces of the back surface of the friction wedge.

18 Claims, 3 Drawing Sheets

U.S. PATENT DOCUMENTS

| | | | | |
|---|---|---|---|---|
| 7,263,931 | B2 | 9/2007 | Forbes | |
| 7,267,059 | B2 | 9/2007 | Forbes | |
| 7,328,659 | B2 | 2/2008 | Forbes | |
| 2001/0054368 | A1 * | 12/2001 | Taillon | 105/198.2 |
| 2004/0261654 | A1 | 12/2004 | Pershwitz et al. | |
| 2005/0223936 | A1 | 10/2005 | Forbes | |
| 2007/0209546 | A1 | 9/2007 | Forbes | |
| 2008/0035011 | A1 | 2/2008 | Forbes | |
| 2008/0127852 | A1 | 6/2008 | Forbes | |
| 2008/0127853 | A1 | 6/2008 | Forbes | |
| 2009/0031918 | A1 * | 2/2009 | Hewitt et al. | 105/198.2 |

* cited by examiner

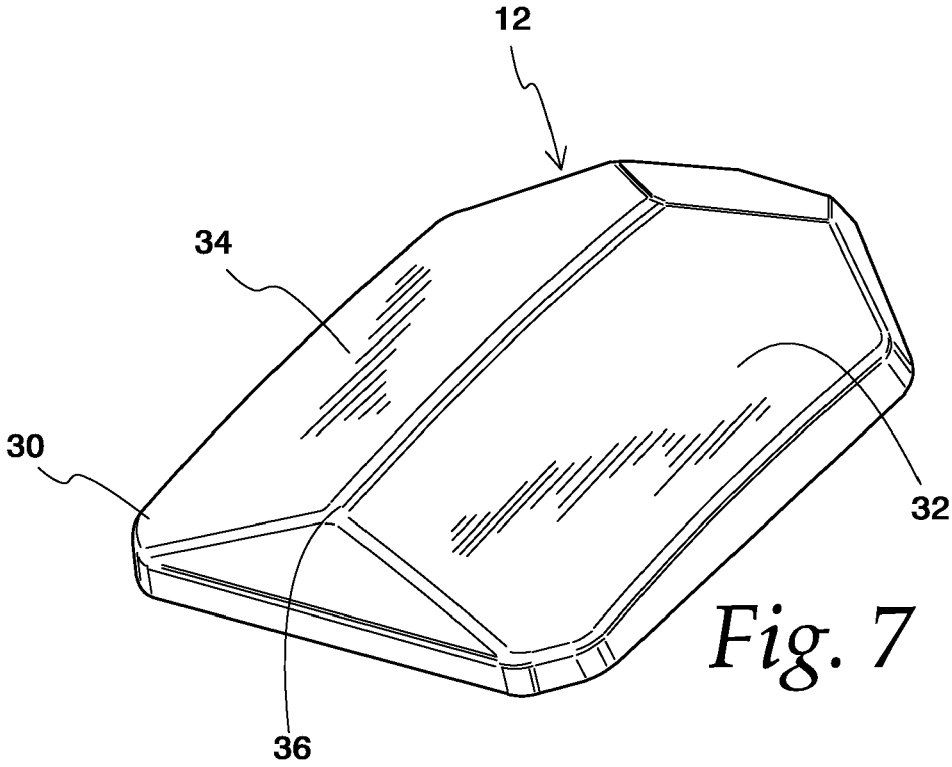
Fig. 7
Fig. 8
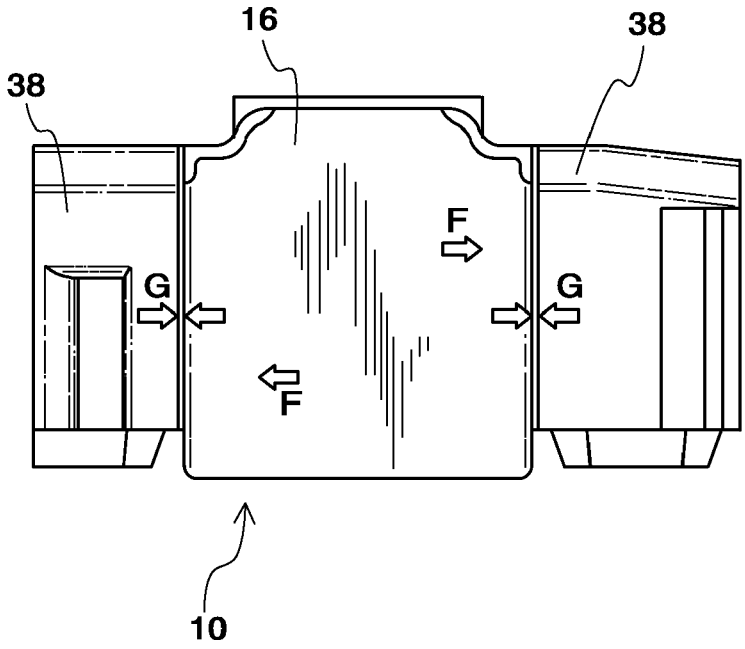

FRICTION WEDGE FOR RAILROAD CAR TRUCK

FIELD OF THE DISCLOSURE

This disclosure generally relates to damping systems for rail car trucks. More particularly, the disclosure relates to friction wedges which are spring-loaded in position between a truck's bolster and the column of an associated side frame.

BACKGROUND OF THE DISCLOSURE

A typical "three-piece" railroad car truck comprises two parallel side frames connected by a bolster laterally spanning the distance between the side frames. Each end of the bolster includes at least one, although usually two, wedge-shaped pockets adapted to receive a spring-mounted friction wedge or friction casting.

The side frame to bolster connection design of three-piece trucks is generally characterized by a triangular friction wedge in contact with and contained by the bolster pocket on one side, a vertical surface of the side frame on another, and a spring on the third side. The connection is comprised of three load-bearing interfaces: a bottom surface, a front surface, and a back surface. The wedge surfaces are oriented in the shape of a right triangle with the bottom and front surfaces oriented at a right angle to each other, and the back surface oriented at an acute angle to the front surface. The wedge is oriented with the front surface vertical to allow sliding motion of the bolster relative to the side frame due to dynamic forces of the rail car body. The wedge back surface bears on a sloped face of the bolster pocket, which acts to direct the force of the spring from the bottom surface into the front surface of the wedge. As a result of the wedge configuration and orientation, a force balance is formed on the friction wedge, at the three interfaces, that is governed by the relative position and movement of the bolster to the side frame.

During use of the truck, most typically at high operating speeds, "hunting" is known to occur. The term "hunting" refers to the situation wherein one of the side frames gets ahead of the other side frame, which misalignment causes the bolster to rotate about a vertical axis from its ideal perpendicular orientation with respect to the side frames. This disorientation of the bolster leads to several problems. For one, the forces acting upon the bolster and side frame can cause relative lateral movement therebetween which, in turn, causes relative lateral movement between the friction wedge and the bolster pocket. Such movement can cause wear to the side walls of the pocket and/or the sides of the friction wedge, especially if the friction wedge is allowed to repeatedly, forcefully press or rub against the pocket.

Another problem caused by "hunting" is the tendency of the spring supporting the friction wedge to deflect from its ideal, vertical orientation. This deflection causes the friction wedge to rotate within the pocket, pressing an upper corner and the opposite lower corner of the wedge against opposite side walls of the pocket, creating a squeezing force that can wear the pocket and/or the wedge.

The ability of the truck to resist these unsquaring forces is referred to as its warp restraint or warp resistance. There are different types of friction wedges, each having different warp resistance characteristics. The different types of friction wedges can be generally categorized as either of unitary or combination construction and as either of a single-piece or split construction. A unitary friction wedge is cast as a single metal body, typically of iron or steel. On the other hand, in a combination friction wedge, a plate or insert is positioned between a support wedge body and the bolster pocket to provide the aforementioned back surface or otherwise modify the interaction between the support wedge body and the pocket. Use of a wear plate or insert is discussed in U.S. Pat. Nos. 3,559,589 to Williams; 4,426,934 Geyer; 4,974,521 to Eungard; 5,555,817 to Taillon, et al.; and 5,850,795 to Taillon, all of which are hereby incorporated herein by reference.

A friction wedge with a single-piece construction is a wedge configured to occupy the entirety of an associated bolster pocket. In contrast, when multiple wedges (typically two half-sized wedges that are usually supported by a single spring) are configured to be received in a single bolster pocket, it is often referred to as a split configuration. Both single-piece and split wedges may also be unitary or combination wedges, giving a wide variety of possible friction wedge configuration types. U.S. Pat. No. 6,895,866 to Forbes illustrates a number of different unitary/combination/single-piece/split friction wedges and is hereby incorporated herein by reference.

In general, known single-piece friction wedges will provide vertical damping and moderate squaring ability, but are slightly narrower than the associated pocket, allowing them to rotate in the bolster pocket. Consequentially, they do not provide maximum warp resistance. By comparison, split wedges provide vertical damping and a higher squaring ability by spreading away from each other in the bolster pocket to abut the side walls, thereby preventing rotation within the pocket. The split wedges are allowed to move up and down relative to each other to provide increased warp resistance. However, as described above, abutting the side walls of the bolster pocket can cause wear to the pocket and/or the friction wedge, so a friction wedge with a high squaring ability that also avoids contact with the side walls may be advantageous.

SUMMARY OF THE INVENTION

There are several aspects of the present subject matter which may be embodied in the devices and systems described and claimed below. These aspects may be employed alone or in combination with other aspects of the subject matter described herein.

In one aspect, a single-piece friction wedge is provided for use in damping relative movement between a bolster and a side frame of a railroad car truck. The friction wedge comprises a generally horizontal bottom surface, a generally vertical front surface, and a back surface oriented at an acute primary angle with respect to the front surface. The back surface comprises first and second sloped surfaces which are angled toward each other.

In another aspect, a damping system is provided for use in damping relative movement between a bolster and a side frame of a railroad car truck. The damping system comprises a single-piece friction wedge and a bolster pocket insert. The friction wedge comprises a generally horizontal bottom surface, a generally vertical front surface, and a back surface oriented at an acute primary angle with respect to the front surface. The back surface comprises first and second sloped surfaces which are angled toward each other. The bolster pocket insert is configured to be at least partially received within a pocket of the bolster and comprises an inner face configured to engage the pocket of the bolster and an outer face configured to engage at least one of the first and second sloped surfaces of the back surface of the friction wedge.

In yet another aspect, a single-piece friction wedge is provided for use in damping relative movement between a bolster and a side frame of a railroad car truck. The friction wedge comprises a generally horizontal bottom surface, a generally vertical front surface, and a back surface oriented at an acute primary angle with respect to the front surface. The back surface comprises first and second sloped surfaces and a valley therebetween. The first and second sloped surfaces are substantially flat and angled toward each other. Additionally, the sloped surfaces are substantially identical mirror images of each other and define therebetween a secondary angle between approximately 90° and approximately 175°, with the valley defining the vertex of the secondary angle.

BRIEF DESCRIPTION OF THE DRAWINGS

FIG. 7 is a perspective view of the bolster pocket insert shown in FIG. 1.

FIG. 8 is a front elevation of a friction wedge according to the present disclosure received within a bolster pocket, diagrammatically illustrating rotational forces acting upon the friction wedge.

DESCRIPTION OF THE ILLUSTRATED EMBODIMENTS

The embodiments disclosed herein are for the purpose of providing the required description of the present subject matter. These embodiments are only exemplary, and may be embodied in various forms. Therefore, specific details disclosed herein are not to be interpreted as limiting the subject matter of this disclosure or the appended claims.

Friction wedges according to the present disclosure may be employed with rail car damping systems according to known design. The typical elements of a three-piece railroad car truck and associated damping system (i.e., sideframes, a bolster, springs, etc.) are well known to those of skill in the art and will not be described in detail herein. However, reference may be made to any of a number of patents from Standard Car Truck Company of Park Ridge, Ill. for a description of such elements. Among the patents describing the elements of known trucks and damping systems are U.S. Pat. Nos. 5,511,489 and 5,850,795, both of which are hereby incorporated herein by reference.

Figure 1:
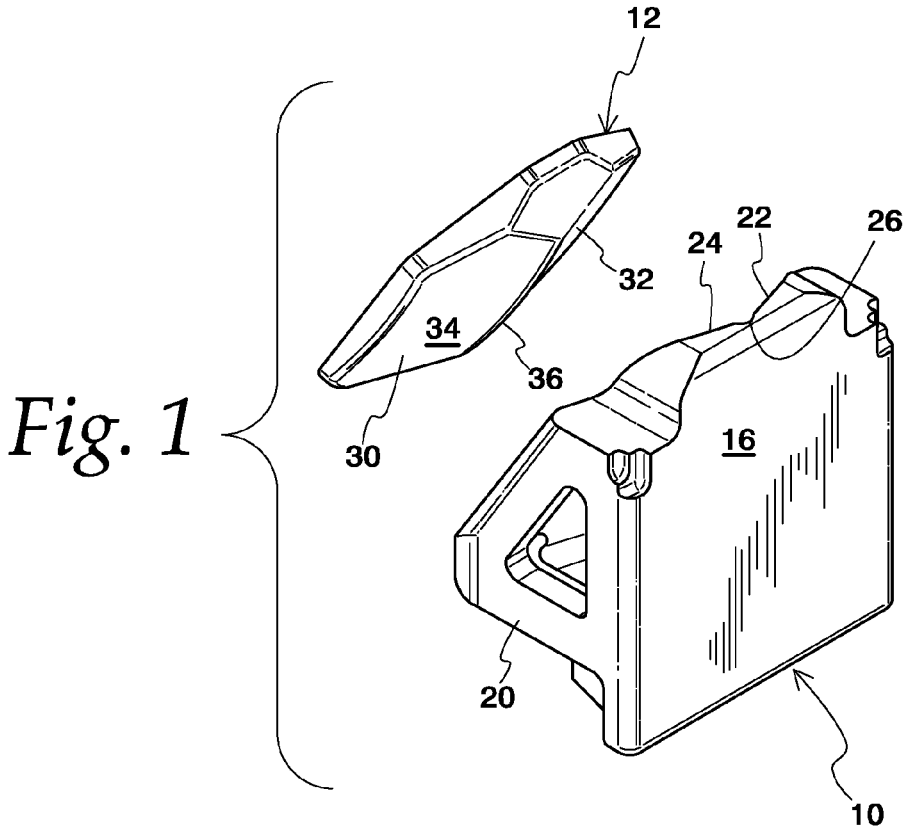
FIG. 1 is a front perspective view of a friction wedge and a bolster pocket insert according to the present disclosure.
Figure 2:
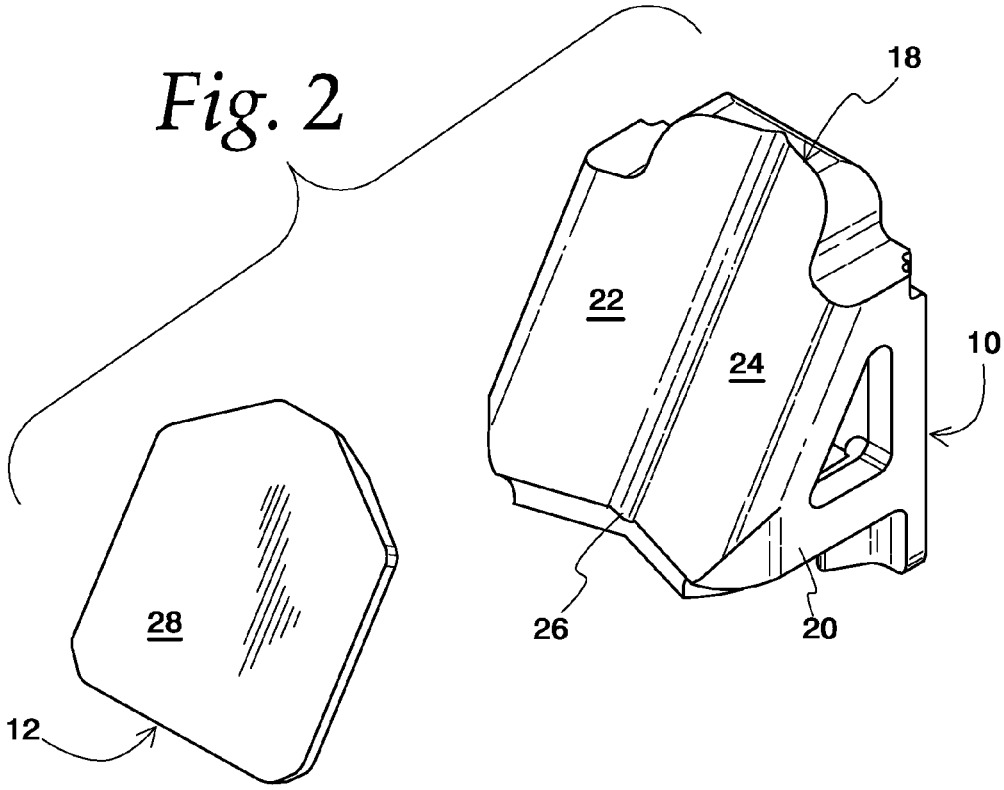
FIG. 2 is a rear perspective view of the friction wedge and bolster pocket insert of FIG. 1.

FIGS. 1-6 illustrate a friction wedge 10 according to the present disclosure. FIGS. 1 and 2 also show a bolster pocket insert 12 suitable for use in combination with the friction wedge 10, as will be described in greater detail herein.

Figure 3:
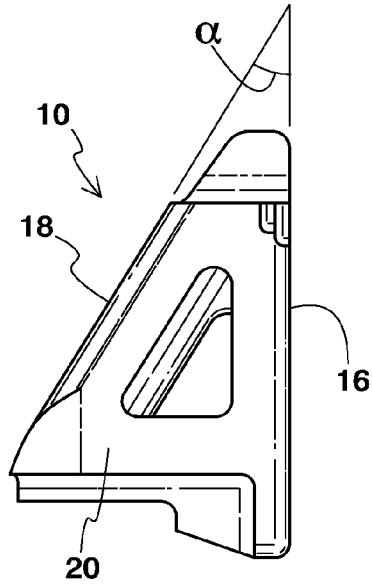
FIG. 3 is a side elevation of the friction wedge shown in FIG. 1.

The friction wedge 10 is of a single-piece construction, as opposed to employing a split wedge design, and includes a generally horizontal bottom surface 14 (FIG. 5), a generally vertical front surface 16 (FIG. 1), a back surface 18 (FIGS. 2, 4, and 6) and sides 20 (only one of which is visible in FIGS. 1-3). The three surfaces and sides are oriented in a generally right triangular configuration according to conventional design, with the back surface 18 being oriented at an acute primary angle $\alpha$ with respect to the front surface 16 (FIG. 3). The extent of the primary angle $\alpha$ may vary, but in one embodiment, may be between approximately 25° and approximately 75°.

The bottom surface 14 of the friction wedge 10 (FIG. 5) is adapted to be seated on a spring or other resilient member, in a manner well known to those of skill in the art.

As for the front surface 16 of the friction wedge 10 (FIG. 1), it is substantially flat and adapted to abut a wear plate mounted to a column of one of the truck side frames, in a manner well known to those of skill in the art.

Turning now to the back surface 18 of the friction wedge 10 (FIGS. 2, 4, and 6), it is comprised of a first sloped surface 22 and a second sloped surface 24. The illustrated sloped surfaces 22 and 24 are substantially flat and substantially identical mirror images of each other. In the illustrated embodiment, a valley 26 is defined between the sloped surfaces 22 and 24, with the back surface 18 being substantially symmetrical about the valley 26.

Figure 6:
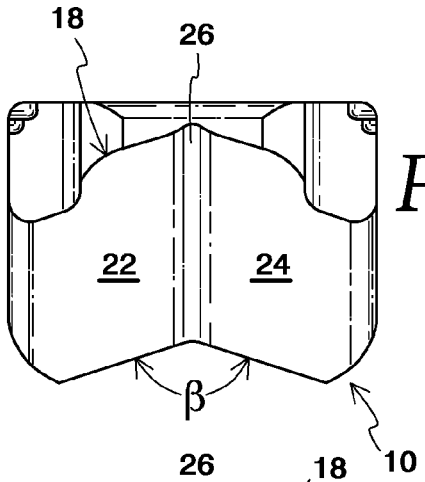
FIG. 6 is a top plan view of the friction wedge shown in FIG. 1.
Figure 4:
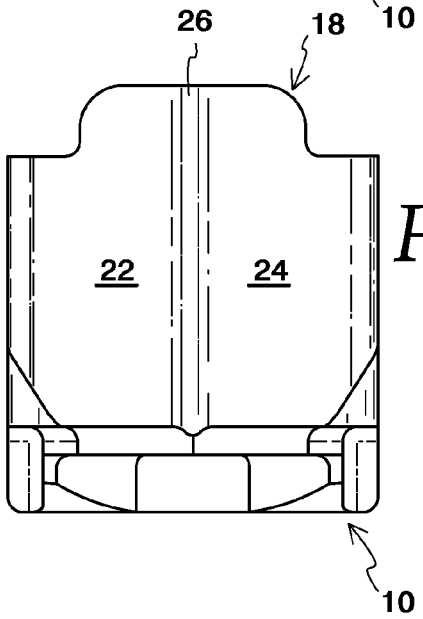
FIG. 4 is a rear elevation of the friction wedge shown in FIG. 1.
Figure 5:
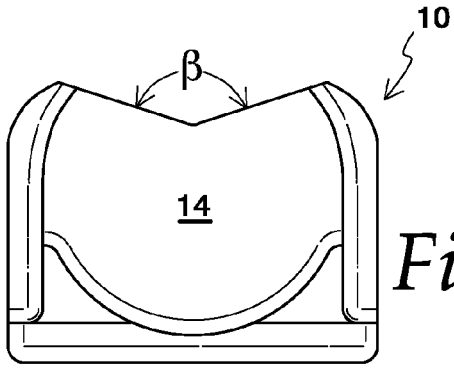
FIG. 5 is a bottom plan view of the friction wedge shown in FIG. 1.

The sloped surfaces 22 and 24 are characterized by two angles: the aforementioned primary angle $\alpha$ (FIG. 3) and a secondary angle $\beta$ (FIGS. 5 and 6). The sloped surfaces 22 and 24 are angled toward each other, with the angle therebetween being referred to herein as the secondary angle $\beta$. When the back surface 18 is provided with a valley 26, the valley 26 may define the vertex of the secondary angle $\beta$. The extent of the secondary angle $\beta$ may vary, but in one embodiment, may be between approximately 90° and approximately 175°.

The back surface 18 of the friction wedge 10 is adapted to be at least partially received by a bolster pocket, in facing relationship to a slanted face of the pocket, in a manner well known to those of skill in the art. Typically, the slanted face of the bolster pocket is substantially flat and slanted away from vertical by the same angle as the back surface 18 of the friction wedge 10 (i.e., the primary angle $\alpha$). However, if the slanted face of the pocket is substantially flat, then it is not well-suited to engagement with the doubly angled back surface 18 of the friction wedge 10, so an insert may be positioned between the slanted face of the pocket and the back surface 18 of the friction wedge 10 to provide a suitable interface.

An exemplary bolster pocket insert 12 is shown in FIGS. 1, 2, and 7. The illustrated bolster pocket insert 12 has an inner face 28 (FIG. 2) and an outer face 30 (FIGS. 1 and 7). The inner face 28 is substantially flat for engagement with the slanted face of the bolster pocket, while the outer face 30 is configured for substantial mating engagement with the back surface 18 of the friction wedge 10. The outer face 30 of the bolster pocket insert 12 has a third sloped surface 32, a fourth sloped surface 34, and a hill or ridge 36 therebetween (FIG. 7). The illustrated third and fourth sloped surfaces 32 and 34 are substantially identical mirror images of each other, with the outer face 30 of the bolster pocket insert 12 being substantially symmetrical about the hill or ridge 36.

The third and fourth sloped surfaces 32 and 34 are angled away from each other so as to provide an outer face 30 that is complementary to the shape of the back surface 18 of the friction wedge 10, such that the third sloped surface 32 will engage the first sloped surface 22 and the fourth sloped surface 34 will engage the second sloped surface 24. With the sloped surfaces 22 and 24 of the friction wedge 10 so engaging the corresponding sloped surfaces 32 and 34 of the bolster pocket insert 12, the hill 36 of the bolster pocket insert 12 may be at least partially received by the valley 26 of the friction wedge 10. As will be described in greater detail herein, the mating sloped surfaces prevent rotation of the friction wedge 10 within the bolster pocket, while a mating hill 36 and valley 26 provide even better resistance to rotation.

In a preferred embodiment the sloped surface 32 by itself defines a somewhat convex shape and the sloped surface 34 by itself is also somewhat convex. Also, while the wedge's sloped surfaces 22, 24 taken together can be considered to define a concave portion of the wedge (with a secondary angle β between the sloped surfaces 22, 24), the sloped surfaces 22, 24 individually are flat. As a result of the convex shape of each insert sloped surface contacting a flat sloped surface of the wedge, each sloped surface 32, 34 will engage its corresponding sloped surface 22, 24, respectively, in a line contact. It will be understood that alternately this arrangement of convex and flat surfaces could be reversed. That is, each sloped surface 22 and 24 could individually form a convex shape that engages an insert surface 32, 34 that is individually flat. Note that the reference here to convex surfaces is meant to describe each individual surface by itself and not in relation to an adjacent surface. Thus, in this alternate arrangement surfaces 22 and 24 taken together could be considered to form a concave configuration for the back surface 18 in its entirety, while each surface by itself has a convex shape.

In use, the friction wedge 10 is positioned in a conventional damping relationship between a truck side frame and bolster, with the horizontal bottom surface 14 of the friction wedge 10 resting upon a spring or resilient member, the vertical front surface 16 engaging a column wear plate, and the back surface 18 facing the slanted face of the bolster pocket. A bolster pocket insert 12 is positioned between the back surface 18 of the friction wedge 10 and the slanted face of the bolster pocket, in accordance with the foregoing description. The inner face 28 of the bolster pocket insert 12 may be secured to the slanted face of the bolster pocket by welding or other means.

FIG. 8 illustrates the friction wedge 10 received within a pocket of the bolster 38, as seen from the perspective of the associated column wear plate. As shown in FIG. 8, the friction wedge 10 may be narrower than the bolster pocket, such that there is a gap G between each side 20 of the friction wedge 10 and the adjacent side wall of the bolster pocket. Hence, the width of the friction wedge 10 depends on the width of the associated bolster pocket, but may vary from approximately three to approximately fifteen inches in one embodiment.

FIG. 8 also illustrates rotational forces F that tend to develop during use of the truck and try to rotate the friction wedge 10 until an upper corner and opposite lower corner bear against the sides of the bolster pocket. The geometric constraints arising from the mating relationship between the sloped surfaces (and the hill and valley if provided) of the outer face 30 of the bolster pocket insert 12 and the back surface 18 of the friction wedge 10 prevent the friction wedge 10 from rotating out of square within the bolster pocket. Additionally, the geometric constraints also keep the friction wedge 10 centered within the bolster pocket, so as to prevent contact between the sides 20 of the friction wedge 10 and the side walls of the bolster pocket. Accordingly, friction wedges according to the present disclosure provide optimized damping and warp stiffness to stabilize the truck at high speed operating conditions, while also preventing wear of the side walls of the bolster pocket.

In an alternative embodiment, rather than providing an insert 12 between a flat slanted face of the bolster pocket and the friction wedge 10, the slanted face of the bolster pocket may be doubly angled to provide a surface that is complementary to the shape of the back surface 18 of the friction wedge 10. Other than this change to the bolster pocket-friction wedge interface, the damping system functions according to the foregoing description.

Friction wedges and bolster pocket inserts according to the present disclosure may be fabricated from any material, although it may be advantageous for them to be comprised of metal. They may also be provided with a "secondary" composite material that differs from the "primary" material (typically metal). For example, the friction wedge and/or the bolster pocket insert may have a metallic construction, with a composite outer surface or layer. In one embodiment, the friction wedge is metallic with a non-metallic material, such as an elastomeric material, covering or otherwise secured to all or a portion of the bottom surface, the front surface, the back surface, and/or the sides thereof.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims.

The invention claimed is:

1. A single-piece friction wedge for use in damping relative movement between a bolster and a side frame of a railroad car truck, the friction wedge configured to be received between and spaced from side walls of a bolster pocket and comprising:

a generally horizontal bottom surface;

a generally vertical front surface; and a back surface oriented at an acute primary angle with respect to the front surface, wherein the back surface comprises first and second sloped surfaces which are angled toward each other with a valley therebetween.

2. The friction wedge of claim 1, wherein the first and second sloped surfaces are substantially identical mirror images of each other.

3. The friction wedge of claim 2, wherein the first and second sloped surfaces are each substantially flat.

4. The friction wedge of claim 1, wherein a secondary angle is defined between the first and second sloped surfaces, the secondary angle being between approximately 90° and approximately 175°.

5. The friction wedge of claim 1, wherein a secondary angle is defined between the first and second sloped surfaces, the valley defining the vertex of the secondary angle.

6. The friction wedge of claim 1, wherein the back surface is substantially symmetrical about the valley.

7. A damping system for use in damping relative movement between a bolster and a side frame of a railroad car truck, the damping system comprising:

a single-piece friction wedge comprising:

a generally horizontal bottom surface;

a generally vertical front surface; and a back surface oriented at an acute primary angle with respect to the front surface, wherein the back surface comprises first and second sloped surfaces which are angled toward each other with a valley therebetween; and a bolster pocket insert configured to be at least partially received within a pocket of the bolster and comprising an inner face configured to engage the pocket of the bolster; and an outer face configured to engage the first and second sloped surfaces of the back surface of the friction wedge and maintain the friction wedge spaced from side walls of the pocket of the bolster.

8. The damping system of claim 7, wherein the first and second sloped surfaces of the back surface of the friction wedge are substantially identical mirror images of each other.

9. The damping system of claim 8, wherein the first and second sloped surfaces of the back surface of the friction wedge are each substantially flat.

10. The damping system of claim 7, wherein a secondary angle is defined between the first and second sloped surfaces of the back surface of the friction wedge, the secondary angle being between approximately 90° and approximately 175°.

11. The damping system of claim 7, wherein a secondary angle is defined between the first and second sloped surfaces of the back surface of the friction wedge, the valley defining the vertex of the secondary angle.

12. The damping system of claim 7, wherein the back surface of the friction wedge is substantially symmetrical about the valley.

13. The damping system of claim 7, wherein the outer face of the bolster pocket insert comprises third and fourth sloped surfaces which are angled away from each other, the third sloped surface being configured to engage one of the first and second sloped surfaces of the back surface of the friction wedge, and the fourth sloped surface being configured to engage the other one of the first and second sloped surfaces of the back surface of the friction wedge.

14. The damping system of claim 13, wherein the outer face of the bolster pocket insert further comprises a hill between the third and fourth sloped surfaces and the hill is configured to be at least partially received by the valley.

15. The damping system of claim 14, wherein the back surface of the friction wedge is substantially symmetrical about the valley and the outer face of the bolster pocket insert is substantially symmetrical about the hill.

16. The damping system of claim 7, wherein the first and second sloped surfaces of the friction wedge's back surface are convex.

17. The damping system of claim 7, wherein the outer face of the bolster pocket insert is convex.

18. A single-piece friction wedge for use in damping relative movement between a bolster and a side frame of a railroad car truck, the friction wedge configured to be received between and spaced from side walls of a bolster pocket and comprising:

a generally horizontal bottom surface;

a pair of side surfaces configured to face the side walls of the bolster pocket;

a generally vertical front surface; and a back surface oriented at an acute primary angle with respect to the front surface, the back surface comprising first and second sloped surfaces and a valley between the first and second sloped surfaces, wherein the first and second sloped surfaces:

(a) are angled toward each other, (b) are each substantially flat, (c) are substantially identical mirror images of each other, and (d) define therebetween a secondary angle between approximately 90° and approximately 175°, wherein the valley defines the vertex of the secondary angle.

* * * * *